United States Patent [19]

Foster

[11] Patent Number: 4,999,972

[45] Date of Patent: Mar. 19, 1991

[54] GUIDE MEANS FOR ENVELOPE OPENING APPARATUS

[75] Inventor: Dean H. Foster, Stratford, Conn.

[73] Assignee: Pitney Bowes Inc., Stamford, Conn.

[21] Appl. No.: 453,650

[22] Filed: Dec. 20, 1989

[51] Int. Cl.[5] ..... B65B 43/39

[52] U.S. Cl. ..... 53/381.1; 53/266.1; 493/245

[58] Field of Search ..... 53/381 R, 384, 382, 53/266 A, 492; 493/245, 453

[56] References Cited

U.S. PATENT DOCUMENTS

| | | | |
|---|---|---|---|
| 3,015,926 | 1/1962 | Galambos | 53/266 A X |
| 3,474,711 | 10/1969 | Swinyar | 53/384 X |
| 3,828,634 | 8/1974 | Luperti | 271/2 X |
| 3,996,727 | 12/1976 | Irvine et al. | 53/381 R |
| 4,525,986 | 7/1985 | Noll | 53/266 A X |

*Primary Examiner*—James F. Coan

*Attorney, Agent, or Firm*—Donald P. Walker; Melvin J. Scolnick; David E. Pitchenik

[57] ABSTRACT

In a machine including framework and structure for feeding an unsealed envelope downstream in a path of travel, the envelope having a body portion and a flap portion folded in overlying relationship with the body portion, apparatus for unfolding the flap portion comprising: a guide member including a first portion extending downstream alongside the path of travel and a second portion angularly-extending from the first portion and into the path of travel; and structure for movably supporting the guide member, the supporting structure including an elongate arm pivotably connected to the framework, and the guide member connected to the arm and movable therewith.

11 Claims, 2 Drawing Sheets

GUIDE MEANS FOR ENVELOPE OPENING APPARATUS

BACKGROUND OF THE INVENTION

This invention is generally concerned with apparatus for opening envelopes and more particularly with the provision of movable means for guiding the flap portion of an envelope.

In high speed envelope feeding machines which are constructed and arranged for opening envelopes as a preparatory step to further processing, such as stuffing, moistening and sealing, there has been a long felt need for simplified structure for performing the function of opening the flap portions of the envelopes while avoiding jamming them against the opening structure. Various attempts to provide such structures are shown in U.S. Pat. Nos.: 2,028,277 for an Envelope Flap Opening and Moistening Device, issued Jan. 21, 1936 to Finfrock; 3,474,711 for a Envelope Flap Deflecting Apparatus, issued Oct. 28, 1969, to Swinyar; 3,747,297 for a Flap-Opening Apparatus, issued July 24, 1973, to Hankins; 3,910,007 for a Device For Opening the Flaps of Envelopes, issued Oct. 7, 1975 to Dorer; 3,935,800 for a Flap Separating Mechanism, issued Feb. 3, 1976 to Sette, et al; 3,974,749 for Envelope Flap Separating and Distending Method and Mechanism, issued Aug. 17, 1976 to Luperti, et al; 3,996,727 for an Envelope Flap Separating Mechanism, issued Dec. 14, 1976 to Irvine, et al; 4,715,164 for a High Speed Envelope Flap Opening, issued Dec. 29, 1987 to Luperti, et al; 4,813,209 for a Single Cycle Envelope Flap Opener, issued Mar. 21, 1989 to Foster, et al; and 4,846,455 for High Speed Envelope Feeding Apparatus, issued July 11, 1989 to Hurst.

Although the structures shown and described in the above listed U.S. Patents perform the envelope opening function, when envelope feed speeds are accelerated to speeds of up to four envelopes per second, machine down times occasioned by envelope jams and misses occur with increasing frequency, due to minor functional problems inherent in the various envelope opening structures becoming magnified, and due to having to reconsider the magnitude of the forces exerted on rapidly moving envelopes to achieve desirable, while avoiding undesirable, envelope distortion effects arising from the differences between the physical characteristics of rapidly versus slowly moving envelopes.

Accordingly:

An object of the invention is to provide simplified apparatus for opening an envelope; and Another object is to provide envelope opening apparatus including a guide member and structure for movably supporting the guide member for movement thereof relative to the path of travel of envelopes fed thereto.

SUMMARY OF THE INVENTION

In a machine including framework and means for feeding an unsealed envelope downstream in a path of travel, the envelope having a body portion and a flap portion folded in overlying relationship with the body portion, apparatus for unfolding the flap portion comprising: a guide member including a first portion extending downstream alongside the path of travel and a second portion angularly-extending from the first portion and into the path of travel; and means for movably supporting the guide member, the supporting means including an elongate arm pivotably connected to the framework, and the guide member connected to the arm and movable therewith.

BRIEF DESCRIPTION OF THE DRAWINGS

As shown in the drawings wherein like reference numerals designate like or corresponding parts throughout the serial views.

DESCRIPTION OF THE PREFERRED EMBODIMENTS

Figure 1:
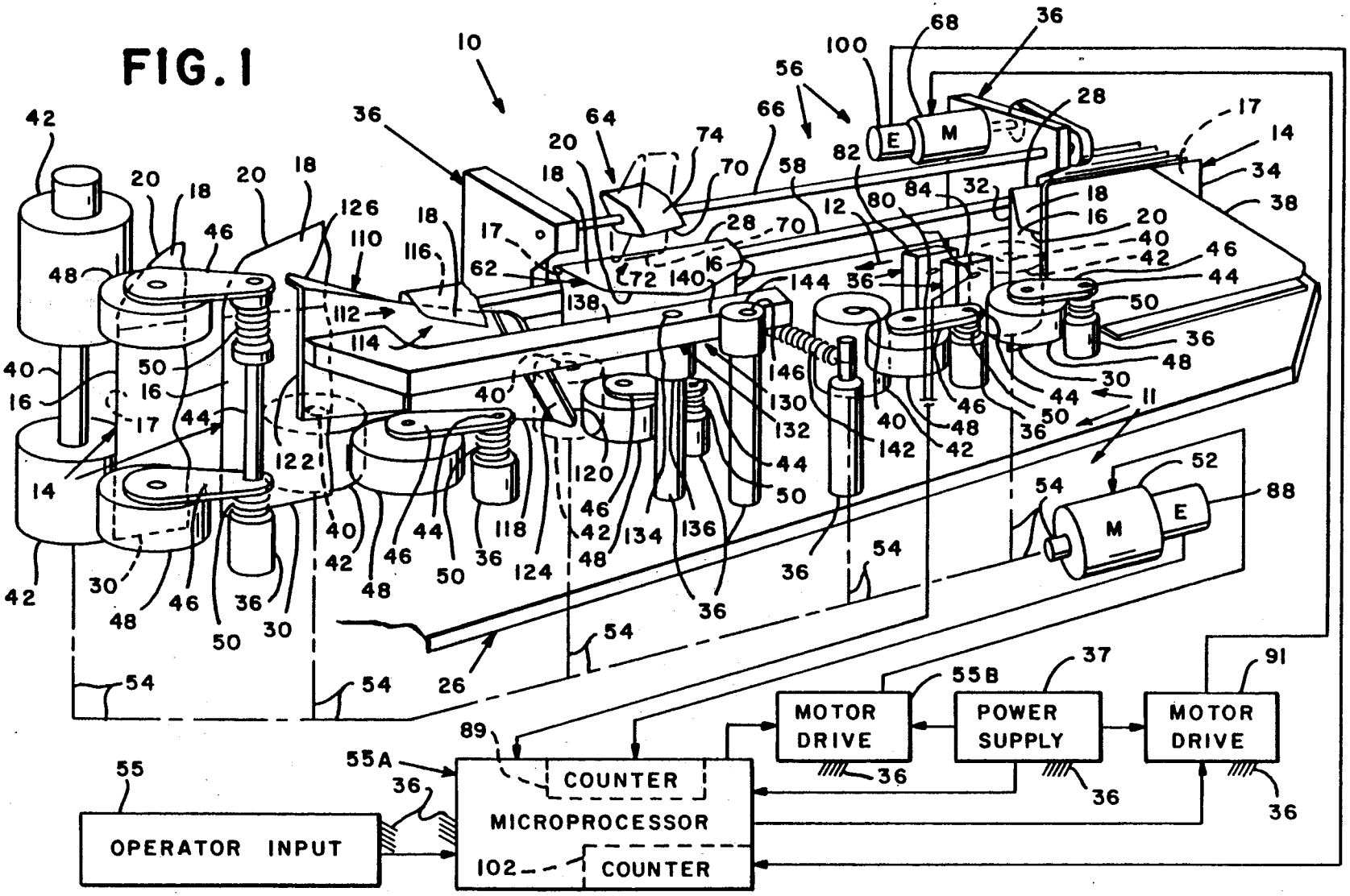
FIG. 1 is a partial perspective view of a an envelope processing machine according to the invention, showing envelope opening apparatus including a guide member and means for movably supporting the guide member.

As shown in FIG. 1, an envelope processing machine 10 in which the invention is incorporated includes structure, generally designated by the numeral 11, for feeding unsealed envelopes 14 in a downstream path of travel 12. Each of the envelopes 14 includes a body portion 16 having a front wall 17, and includes a flap portion 18 which has a free edge 20 and is folded in overlying relationship with the body portion 16. In addition, the machine 10 generally includes a feed deck 26 on which the envelope 14 is preferably uprightly oriented for registration purposes. As thus oriented, the envelope 14 has an upper fold edge 28, defined by the body and flap portions, 16 and 18, and a lower feed deck registration edge 30, defined by the body portion 16. In addition, as viewed in relation to the downstream path of travel 12 thereof, the envelope 14 has a leading edge 32 and a trailing edge 34. Moreover, the machine 10 generally includes framework 36 which is conventionally fixedly attached to the feed deck 26 for supporting various components of the machine 10, including a conventional d.c. power supply 37, an envelope input guide member 38 and the components of the invention hereinafter described.

According to the invention, the envelope feeding structure 11 (FIG. 1) preferably includes a plurality of upright drive shafts 40, which are generally located at spaced intervals along a line extending parallel to one side of the path of travel 12, and includes a plurality of feed rollers 42, which are mounted on a one-for-one basis on the shafts 40 and are respectively dimensioned for defining the path of travel 12. In addition, the machine 10 includes a plurality of pivot shafts 44, which are generally located at spaced intervals along a line extending parallel to the other side of the path of travel 12. Moreover, the machine 10 includes a plurality of bracket arms 46, each having one end thereof suitably pivotally connected on a one-for-one basis to the pivot shafts 44, and includes a plurality of idler roller 48 which are conventionally rotatably connected on a one-for-one basis to the other ends of the bracket arms 46. Further, the machine 10 includes a plurality of springs 50 which are suitably connected on a one-for-one basis between the pivot shafts 44 and bracket arms 46 and are biased for urging each of the arms 46, and thus the idler rollers 48 carried thereby, toward an oppositely located feed rollers 42. As thus constructed and arranged, the respective idler rollers 48 are urged by the spring loaded bracket arms 46 into engagement with envelopes 14 fed thereto, for urging the envelopes 14 into feeding engagement with the feed rollers 42. Preferably, for driving the feed rollers 42, the machine 10 further includes a d.c. motor 52, which is conventionally connected to the framework 36, and a suitable drive train 54, which is conventionally connected between the motor 52 and the respective drive shafts 40 for driving the shafts 40 when the motor 52 is energized. In addition, the machine 10 includes a suitable operator input structure 55 connected to a conventional microprocessor 55A for controlling a motor drive circuit 55B to energize and deenergize the d.c. motor 52 in response to input signals received by the microprocessor 55A from the operator input structure 55.

According to the invention, the machine 10 (FIG. 1) also includes apparatus, generally identified by the numeral 56, for bending an envelope 14. The bending apparatus 56 includes an elongate guide member 58, which is suitably connected at its opposite ends to the framework 36 so as to extend substantially parallel to both the feed deck 26 and the path of travel 12 of the envelope 14. Preferably, the guide member 58 is vertically located above the feed deck 26 a distance which is selected to ensure that the guide member's upper surface 60 is located below the fold edge 28, and above the lowest part of the free edge 20 of the flap portion 18, of any given envelope 14 used by a commercial mail processors.

According to the invention, the envelope bending apparatus 56 (FIG. 1) also includes structure for urging each envelope's body portion 16 against the guide member 58, to form a gap 62 between the body portion 16 and the free edge 26 of the flap portion 18, when the envelope 14 is fed downstream in the path of travel 12. To that end the bending apparatus 56 includes a finger member 64, an elongate rotatable shaft 66 to which the finger member 64 is fixedly connected for rotation therewith, and a stepper motor 68. Preferably, the shaft 66 is suitably journaled for rotation to the framework 36 so as to extend parallel to the path of travel 12, at an elevation above the feed deck 26 which is selected to ensure that the free end 70 of the finger member 64 is rotatable into and out of overlying engagement with any envelope's fold edge 28. Moreover, the finger member 64 is preferably dimensioned to ensure that when the finger member 64 is moved into engagement with the envelope's flap portion 18, the finger member's free end 70 barely engages a minor marginal portion 72 of the envelope's flap portion 18 which extends along the fold edge 28 Moreover, the finger member's free end 70 is preferably curvedly-shaped for camming engagement with envelope's flap portion 18. Thus the finger member 64 is preferably a cam 64 having at least one cam lobe 74, and the shaft 66 is preferably a cam shaft 66 to which the cam 64 is conventionally connected for rotation.

According to the invention, for controlling the machine 10 (FIG. 1), structures are provided for sensing an envelope 14 in the path of travel 12 and for timely energizing and deenergizing the stepper motor 68.

For sensing an envelope 14 (FIG. 1) in the path of travel 12, the machine 10 preferably includes suitable electro-optical sensing structure 80 which is conventionally physically connected to opposed arms, 82 and 84, of the framework 36 for sensing an envelope 14 fed therebetween.

For timely energizing the stepper motor 68 (FIG. 1), to start rotating the finger member 64, the machine 10 preferably includes suitable time delay apparatus which is functionally connected between the sensing structure 80 and d.c. motor 52, for energizing the stepper motor 68 in response to the sensing structure 80 sensing an envelope 14 in the path of travel 12. Preferably, the time delay apparatus includes a conventional encoder 88, which is suitably connected to the d.c. motor 52 and includes a counter 89 of the microprocessor 55A. And, the microprocessor 55A is conventionally programmed to respond to the sensing structure 80 sensing an envelope edge, 32 or 34, as the case may be, to cause the counter 89 to commence counting signals received from the encoder 88, and, when the count corresponds to a predetermined time delay interval, to cause a motor drive circuit 91, connected to the power supply 37, to energize the stepper motor 68 for rotating the finger member 64 into or out engagement with the envelope 14. However, without departing from the spirit and scope of the invention, the time delay apparatus may be any other structure for energizing and the stepper motor 68 upon the lapse of a first predetermined time interval after the sensing structure 80 senses the leading edge 32 of an envelope 14, for example, when the envelope's leading edge 32 is located approximately one inch (1") downstream from the finger member 64; and, assuming that the stepper motor 68 has been timely deenergized as hereinafter discussed, to again energize the stepper motor 68 upon the lapse of a second predetermined time interval after the sensing structure 80 senses the envelope's trailing edge 34, for example, when the envelope's trailing edge 34 is fed out of engagement with the finger member 64.

For timely deenergizing the stepper motor 68 (FIG. 1), to stop rotating the finger member 64, the machine 10 preferably includes a conventional encoder 100 which is suitably connected to the stepper motor 68, and includes another counter 102 of the microprocessor 55A. And, the microprocessor 55A is conventionally programmed to respond to the microprocessor 55A causing the motor drive circuit to energize of the stepper motor 68, to cause the counter 102 to commence counting signals from the encoder 100 and to cause the motor drive circuit 91 to deenergize the stepper motor 68 when the count corresponds to a predetermined angle of rotation of the shaft 66, and thus of the finger member 64. As thus constructed and arranged, the predetermined angle of rotation may be adjusted to accommodate the use of finger members 64 of various configurations, including for example a cam 64 having one or more cam lobes 74.

According to the invention, the machine 10 also includes a guide member 110 which is connected to the framework 36 so as to extend into the path of travel 12 for engaging envelopes 14 fed thereto downstream of the finger member 64. Preferably the guide member 110 comprises an elongate plate made of sheet metal which is suitably shaped to define a downstream portion 112 thereof, which extends alongside, and preferably substantially parallel, to the path of travel 12, and an upstream portion 114 thereof, which angularly extends into the path of travel 12 from the downstream portion 112. The guide member 64 also includes longitudinally-extending upper and lower edges, respectively designated 116 and 118, and includes an upstream edge 120 and a downstream edge 122. Preferably, a marginal portion 124 of the upstream portion 114 of the member 64, which portion 124 extends alongside the upstream edge 120, curvedly extends out of the path of travel 12. In addition, the member's upper edge 116 angularly extends upwardly, from the upstream edge 120 to the doWnstream edge 122. And, a marginal portion 126 of the member's downstream portion 112, which portion !26 extends alongside the member's upper edge 116, angularly extends a progressively greater distance into the path of travel 12 as it extends downstream thereof.

As thus constructed and arranged, when the guide member 110 (FIG. 1) is engaged by an envelope 14 fed downstream from the finger member 64, if the force exerted by the finger member 64 against the envelope 14 causes the envelope's body portion 16, located below the guide member 58, to be moved slightly out of the path of travel 12, then, the guide member's curvedly-shaped upstream marginal portion 124 will deflect and guide the envelope's body portion 16 back into the path of travel 12. Moreover, as the envelope 14 is progressively fed into engagement with guide member 58, the envelope's flap portion 18 is initially elevated to extend 90° from the body portion 16 by the guide member's upper edge 116, as the flap portion 18 traverses the guide member's upstream portion 114, and the flap portion 16 is then elevated at least an additional 90° from the body portion 16 by the guide member's upper edge 116, as the flap portion 18 traverses the guide member's upstream marginal portion 126. Thus the guide member's upper edge 16 progressively lifts the envelope's flap portion 18 and guides the free edge 20 thereof progressively upwardly until the flap portion 18 either lies in a vertical plane coextensive with the envelope's body portion 16 or passes through the vertical plane. Preferably, the flap portion 18 passes through the vertical plane so as to slightly overhang the envelope body portion's front wall 17 by, say 5°, to facilitate engagement by the downstream, flap-engaging idler and feed rollers, 48 and 42.

According to the invention, the machine 10 (FIG. 1) preferably additionally includes structure, generally designated by the numeral 130, for movably, supporting the guide member 110. The supporting structure 130 includes an elongate pivot arm 132 which is conventionally pivotably attached to the framework 36, as by means of a pivot pin 134 connected to an upright post 136 which is fixedly attached to the framework 36. The pivot arm 132 is thus divided into elongate portions 138 and 140 extending in opposite directions from the pivot pin 134. The guide members 110 is conventionally fixedly attached to the pivot arm portion 138. And the guide supporting structure 130 includes a spring 142 which is connected between the other pivot arm portion 140 and the framework 36 and is biased for urging the pivot arm portion 138, and thus the guide member 110 carried thereby, toward the downstream path of travel 12. In addition, the guide supporting structure 130 includes a stop member 144 which is conventionally eccentrically movably connected to the framework 36, as by means of a pivot pin 146, for manual movement thereof in bearing engagement with the pivot arm portion 140 against the force exerted by the spring 142. As thus constructed and arranged, the stop member 144 is movable to a greater or lesser extent against the force exerted by the spring 142 for moving the guide member 58 toward and away from the downstream path of travel 12 to accommodate different thicknesses of envelopes 14 fed by the machine 10. Moreover, since the guide member 110 is movable by an envelope 14 fed into engagement therewith, against the force exerted by the spring 142, the guide member 110 tends to yield to the force exerted thereagainst by the envelope 14, thereby diminishing the force that would otherwise be exerted on the envelope 74 by the guide member 110. Thus, the envelope 14 experiences what may be termed a "soft landing" on the guide member 110, resulting in diminishing the number of jams, and thus the resulting down time, experienced by the machine 10.

Figure 2:
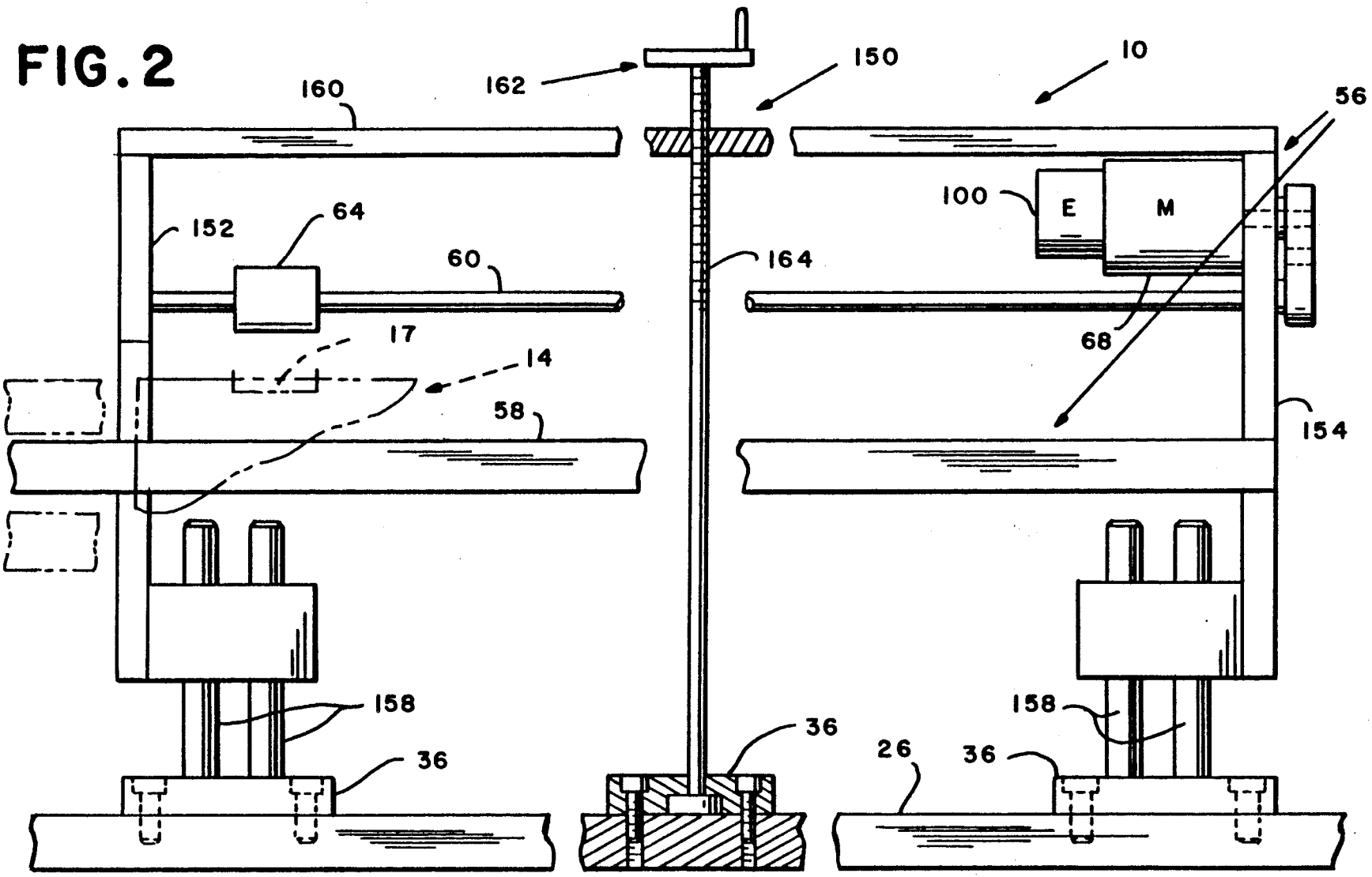
FIG. 2 is an alternate embodiment of the envelope opening apparatus shown in FIG. 1.

As shown in FIG. 2, according to the invention, the machine 10 may additionally include structure, generally designed by the numeral 150, for changing the elevation of the bending apparatus 56 relative to the feed deck 26, to accommodate opening different sizes of envelopes 14. To that end, the machine 10 may include a pair of plate members 152 and 154, which are spaced apart from one another and conventionally slidably connected to the framework 36, as by means of opposed blocks 157, which are fixedly attached on a one-for-one basis to the plate members, 152 and 154, and a plurality of guide pins 158 extending through each of the blocks 157 from the framework 36. And the components of the bending apparatus 56, including the guide member 58, shaft 66, finger member 64 and stepper motor 68 may be connected, rather than to the framework 36 as hereinbefore discussed, to the plate member's, 152 and 154, for movement therewith. And, for moving the plate members, 152 and 154, and thus the bending apparatus 56, the machine 10 may be further provided with an elongate bar 160 having its opposite ends connected to the plate members 152 and 154, on a one-for-one basis. And, in addition, the machine 10 may include a hand crank 162, including a shaft 164 which is threadably connected to the bar 140 and conventionally journaled to the feed deck 26 for raising and lowering the plate members, 152 and 154, and thus the bending apparatus 56 carried thereby, relative to the feed deck 26. However, without departing from the spirit and scope of the invention other suitable structure may be provided for changing the elevation of bending apparatus 56 relative to the feed deck 26.

In accordance with the objects of the invention there has been disclosed simplified apparatus for opening an envelope including a guide member and means for movably supporting the guide member for movement thereof relative to the path of travel of envelope fed thereto. Although the invention has been disclosed with reference to simple embodiments thereof, variations and modifications may be made therein without departing from the spirit and scope of the invention. Accordingly, it is intended that the following claims cover the invention as disclosed and such variations and modifications thereof which are within the spirit and scope of the invention.

What is claimed is:

1. In a machine including framework and means for feeding an unsealed envelope downstream in a path of travel, the envelope having a body portion and a flap portion folded in overlying relationship with the body portion, apparatus for unfolding the flap portion comprising:

a. a guide member including a first portion extending downstream alongside the path of travel and a second portion angularly-extending from the first portion and into the path of travel, the guide member including an upstream edge and a downstream edge, and the guide member including an upper edge extending upwardly from the upstream edge to the downstream edge for guiding the flap portion of an envelope into engagement with the feeding means; and b. means for movably supporting the guide member, the supporting means including an elongate arm pivotally connected to the framework, and the guide member connected to the arm and movable therewith.

2. The apparatus according to claim 1, wherein the supporting means includes a shaft for pivotably connecting the arm to the framework, the arm including elongate portions thereof extending in opposite directions from the shaft, the guide member extending from one of the arm portions, and a spring connected to the other arm portion and biased for urging the one arm portion and thus the guide member toward the path of travel.

3. The apparatus according to claim 2, wherein the supporting means includes an adjustable stop normally disposed in bearing engagement with the other arm portion for positioning the guide member relative to the path of travel such that the guide member is movable out of the path of travel against the force exerted by the spring.

4. The apparatus according to claim 1, wherein the guide member's marginal portion is dimensioned to permit the upper edge therealong to cause the envelope's flap portion to extend from the body portion at a predetermined angle relative to the body portion.

5. The apparatus according to claim 1, wherein the guide member includes an upstream edge and a downstream edge, the guide member including an upper edge extending progressively upwardly from the guide member's upstream edge to the guide member's downstream edge for progressively upwardly guiding an envelope flap portion fed into engagement therewith.

6. The apparatus according to claim 1, wherein the guide member includes an upstream edge, the guide member's second portion including a marginal portion extending alongside the upstream edge, and the marginal portion curvedly-extending out of the path of travel for deflecting an envelope fed thereto into the path of travel.

7. The apparatus according to claim 4, wherein the predetermined angle is selected to facilitate engagement of the flap portion by the feeding means.

8. In a machine including framework and means for feeding an unsealed envelope downstream in a path of travel, the envelope having a body portion and a flap portion folded in overlying relationship with the body portion, apparatus for unfolding the flap portion comprising:

a. a guide member including a first portion extending downstream alongside the path of travel and a second portion angularly-extending from the first portion and into the path of travel;

b. means for movably supporting the guide member, the supporting means including an elongate arm pivotably connected to the framework, and the guide member connected to the arm and movable therewith;

c. the guide member including an upstream edge and a downstream edge, the guide member including an upper edge extending progressively upwardly from the guide member's upstream edge to the guide member's downstream edge for progressively upwardly guiding an envelope flap portion fed into engagement therewith; and d. the envelope feeding means constructed and arranged for feeding the envelope's body portion downstream in a substantially vertically oriented plane, the guide member's downstream portion including a marginal portion thereof extending alongside the upper edge, and the guide member's marginal portion dimensioned to extend sufficiently into the path of travel to permit the upper edge therealong to guide the envelope's flap portion through the plane of the envelope's body portion.

9. The apparatus according to claim 8, wherein the guide member's marginal portion is dimensioned to permit the upper edge therealong to cause the envelope's flap portion to extend from the body portion at a predetermined angle relative to the body portion.

10. The apparatus according to claim 9, wherein the predetermined angle is selected to facilitate engagement of the flap portion by the feeding means.

11. In a machine including framework and means for feeding an unsealed envelope downstream in a path of travel, the envelope having a body portion and a flap portion folded in overlying relationship with the body portion, apparatus for unfolding the flap portion comprising:

a. a guide member including a first portion extending downstream alongside the path of travel and a second portion angularly-extending from the first portion and into the path of travel; and b. means for movably supporting the guide member, the supporting means including an elongate arm and a shaft for pivotably connecting the arm to the framework, the arm including elongate portions thereof extending in opposite directions from the shaft, the guide member extending from one of the arm portions and movable therewith, a spring connected to the other arm portion and biased for urging the one arm portion and thus the guide member toward the path of travel, the supporting means including an adjustable stop normally disposed in bearing engagement with the other arm portion such that the guide member is movable out of the path of travel against the force exerted by the spring, the stop eccentrically rotatably connected to the framework for adjustment thereof, and the stop movable against the force of the spring for positioning the guide member relative to the path of travel to accommodate different envelope thicknesses.

* * * * *